United States Patent [19]

Turner, Jr.

[11] 3,945,367

[45] Mar. 23, 1976

[54] ENGINE MODIFICATION

[76] Inventor: James Glenn Turner, Jr., 3537 Colgate, Dallas, Tex. 75225

[22] Filed: June 5, 1974

[21] Appl. No.: 476,424

[52] U.S. Cl. ... 123/198 F; 123/DIG. 1; 123/DIG. 7; 123/1 R

[51] Int. Cl.[2] ..... F02D 13/06

[58] Field of Search ..... 123/198 F, DIG. 7, 3, 2, 123/1 R, DIG. 1

[56] References Cited

UNITED STATES PATENTS

| | | | |
|---|---|---|---|
| 948,248 | 2/1910 | Reaugl | 123/198 F |
| 1,013,528 | 1/1912 | Broderick | 123/198 F |
| 1,101,935 | 6/1914 | Jacobs et al. | 123/198 F |
| 1,138,077 | 5/1915 | Buchi | 123/198 F |
| 2,114,655 | 4/1938 | Leibing | 123/198 F |
| 3,744,394 | 7/1973 | Veno | 123/198 F X |
| 3,874,358 | 3/1975 | Crower | 123/198 F |
| 3,885,387 | 5/1975 | Simington | 123/DIG. 7 |

*Primary Examiner*—Charles J. Myhre
*Assistant Examiner*—Ira S. Lazarus
*Attorney, Agent, or Firm*—Richards Harris & Medlock

[57] ABSTRACT

A simple and inexpensive method for converting an N-cylinder automobile engine to an (N/2)-cylinder engine which requires only minor modifications to the basic engine structure. Every other cylinder in the firing order is deactivated by removing adjacent spark plugs. A conduit is connected between the spark plug hole for each such cylinder and the carburetor air cleaner to prevent power stroke vacuum, exhaust stroke compression, and passage of debris. The rocker arm assemblies for each deactivated cylinder are removed to maintain the intake and exhaust valves in a closed position, and thereby discontinue fuel flow and limit the air flow to that through the conduits.

3 Claims, 2 Drawing Figures

ENGINE MODIFICATION

FIELD OF THE INVENTION

This invention relates to internal combustion engines for automobiles, and more particularly to the conversion of an N-cylinder automobile engine to an (N/2)-cylinder engine with only minor modifications to the basic structure of the engine.

THE PRIOR ART

The current energy crisis has spurred many consumers into purchasing small economy cars to conserve fuel and meet increasing fuel costs. Those automobile owners who previously purchased large, uneconomical automobiles are faced with excessive fuel consumption, higher operating costs, and lower trade-in values. Thus, a method of converting the larger cars to a more economically performing vehicle without incurring large modification costs is required as an incentive to conserve fuel.

Methods of converting an N-cylinder automobile engine into a less than N-cylinder engine are in the prior art. Typical are those disclosed in U.S. Pat. Nos. 2,948,274; 3,121,422; 3,158,143; 3,578,116; 3,756,205; and 3,765,394. Each of the methods disclosed requires complex and expensive modifications to the basic engine structure to control the fuel flow to selected cylinders or to selectively deactivate the ignition circuit. None of the disclosed methods are concerned with the debilitative effect that a deactivated cylinder continues to have during the power and compression strokes. Nor do any of the disclosed methods provide a simple and inexpensive method of conversion requiring neither complex mechanical nor complex electrical modifications.

SUMMARY OF THE INVENTION

A structurally simple and inexpensive method of converting an N-cylinder internal combustion engine to an (N/2)-cylinder engine whereby selected cylinders are deactivated in a manner to avert power absorbing cylinder friction. More particularly, every other cylinder in the firing order is deactivated by replacing the adjacent spark plug with a fitting. Conduits are connected between the fittings and an air cleaner to prohibit passage of debris, power stroke vacuum and exhaust stroke compression within each such cylinder. To complete the modification, the rocker arm assemblies for each deactivated cylinder are removed to maintain the intake and exhaust valves in a closed position. Hence, the fuel flow is discontinued and the flow of air is limited to that through the conduits.

DESCRIPTION OF THE DRAWINGS

For a more complete understanding of the present invention and for further objects and advantages thereof, reference may now be had to the following description taken in conjunction with the accompanying drawings in which.

DESCRIPTION OF THE PREFERRED EMBODIMENT

Figure 1:
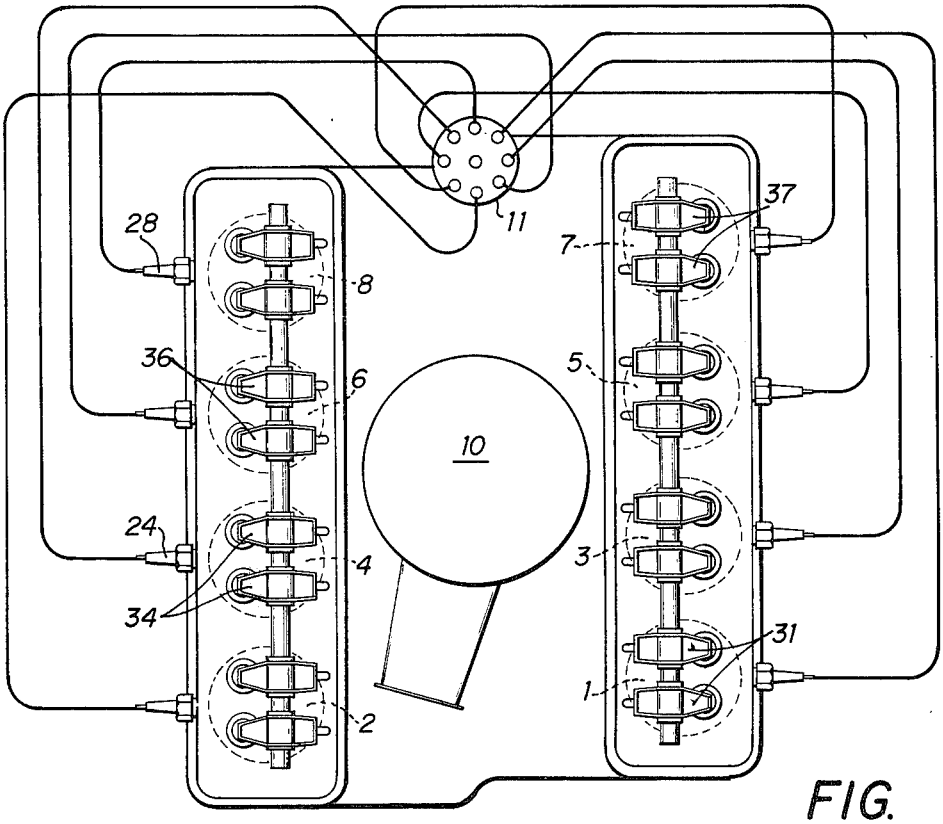
FIG. 1 is a top elevational view of a V-8 automobile engine with valve covers removed to expose the rocker arm assemblies associated with each cylinder.

The engine configuration illustrated in FIG. 1 includes eight cylinder assemblies, preferably a carburetor air cleaner 10, and a distributor 11. Each spark plug, seated in a hole leading to a cylinder chamber, is connected by means of current carrying wires 15 to distributor 11.

The normal firing order for such a configuration is 8-1-3-6-2-7-5-4, where spark plug 28 fires the chamber of cylinder 8 to initiate a firing order which is terminated by spark plug 24 firing the chamber of cylinder 4. The particular firing order results in a balanced and smooth operating V-8 engine.

Figure 2:
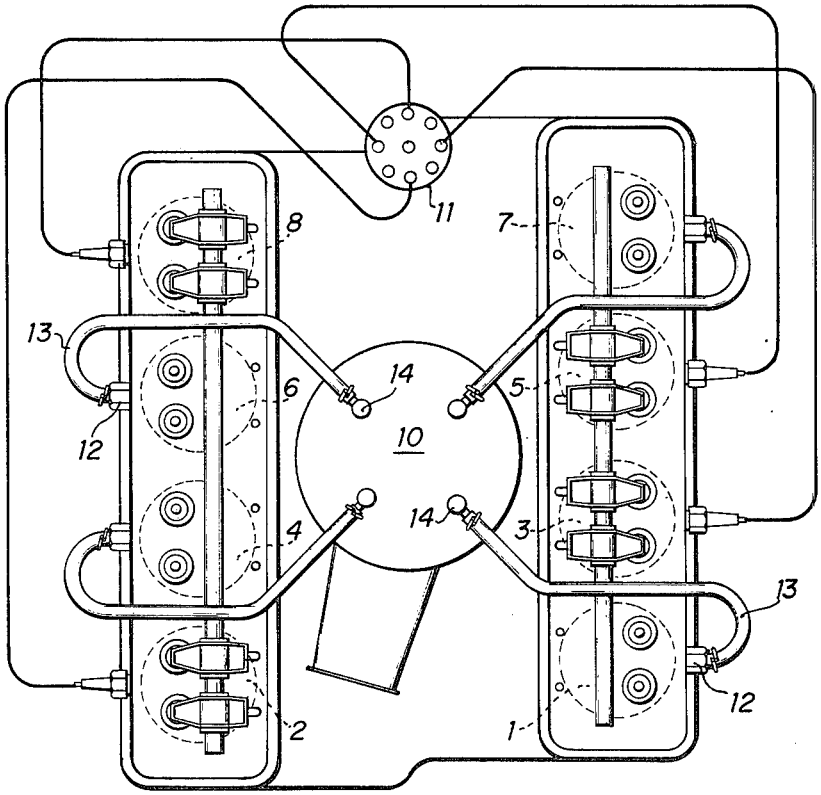
FIG. 2 is a top elevational view of an embodiment of the invention effected upon the engine of FIG. 1.

The preferred embodiment of the invention is illustrated in FIG. 2, where every other cylinder in the firing order, for example cylinders 1, 6, 7 and 4, are rendered inoperative by disconnecting the rocker arm assembly and removing the spark plug for each selected cylinder. A hollow insert or fitting 12 is screwed into each of the vacated spark plug holes, and an air carrying hose 13 is spring clipped to the fitting and preferably to a hollow connector 14 fixed in the top of air cleaner 10. Ignition wires 15 which were connected to the removed spark plugs may be removed from the distributor cap 11 and laid away for reuse when the full V-8 operation is again desired.

While the preferred embodiment includes an air carrying hose between vacated spark plug holes and a carburetor air cleaner, other air cleaner configurations will be obvious to one skilled in the art. For example, a separate manifold containing a cheaper air filter may be utilized on each side of the engine, or a small separate air cleaner may be used for each inoperative cylinder.

With rocker arm assemblies 31, 36, 37 and 34 removed, the intake and exhaust valves associated with each deactivated cylinder are maintained in a closed position to interrupt fuel flow and to close all air passages except that of the spark plug hole.

It is to be understood that the removal of the rocker arm assemblies necessitates the removal of hydraulic lifters and push rods extending to the rocker arms.

The vacuum normally created during the power stroke of an inoperative cylinder as well as compression created during the compression stroke is prevented by the air passage created by hoses 13. Thus, power robbing cylinder friction associated with deactivated cylinder operations is eliminated. Hoses 13 acting in conjunction with air cleaner 10 further prevent the passage of debris into the cylinder chambers.

In operation, the engine illustrated in FIG. 1 has been converted without expensive or complex modification to function as a smooth operating and more economical V-4 engine with firing order: 8-3-2-5.

Having described the invention in connection with certain specific embodiments thereof, it is to be understood that further modifications may now suggest themselves to those skilled in the art and it is intended to cover such modifications as fall within the scope of the appended claims.

What is claimed is:

1. In an internal combustion engine having N-cylinders with each cylinder having at least one removable spark plug for igniting a fuel mixture within the cylinder, and an intake and exhaust valve system for introducing the fuel mixture into the cylinder and exhausting the burned fuel after ignition, a method of converting the engine to a (N/2)-cylinder internal combustion engine comprising:

selecting (N/2)-cylinders to be deactivated, removing the spark plugs from the selected (N/2)-cylinders, attaching an air cleaner to each opening created by the removal of the spark plugs to prevent contaminants from entering the cylinders while allowing the free movement of air into and out of the cylinders, and deactivating the intake and exhaust valve system for the selected (N/2)-cylinders.

2. The method of claim 1 wherein the step of attaching an air filter to each opening created by the removal of the spark plugs is characterized by:

inserting a fitting into each opening created by the removal of the spark plug; and connecting an air hose between each fitting and an air cleaner.

3. The method of claim 1 wherein the step of deactivating the intake and exhaust valve system is characterized by:

removing structure from the intake valve system to prohibit the introduction of the fuel mixture into the selected (N/2)-cylinders, and removing structure from the exhaust valve system to prohibit exhuast from the selected (N/2)-cylinders through the exhaust valve system.

* * * * *